US012757949B2

(12) United States Patent
Coffee, Jr.

(10) Patent No.: US 12,757,949 B2
(45) Date of Patent: Oct. 13, 2026

(54) MULTIFUNCTIONAL HIP WADERS

(71) Applicant: Wesley Coffee, Jr., Yelm, WA (US)

(72) Inventor: Wesley Coffee, Jr., Yelm, WA (US)

( * ) Notice: Subject to any disclaimer, the term of this patent is extended or adjusted under 35 U.S.C. 154(b) by 258 days.

(21) Appl. No.: 18/810,650

(22) Filed: Aug. 21, 2024

(65) Prior Publication Data

US 2025/0255364 A1 Aug. 14, 2025

Related U.S. Application Data

(60) Provisional application No. 63/553,160, filed on Feb. 14, 2024.

(51) Int. Cl.
*A41D 13/012* (2006.01)
*A41D 13/02* (2006.01)
*B63C 9/115* (2006.01)

(52) U.S. Cl.
CPC ..... *A41D 13/0125* (2013.01); *A41D 13/02* (2013.01); *B63C 9/115* (2013.01)

(58) Field of Classification Search
CPC .. B63C 9/00; B63C 9/08; B63C 9/087; B63C 9/093; B63C 9/11; B63C 9/115; B63C 9/13; A41D 13/00; A41D 13/12; A41D 13/125; A41D 13/02
USPC ... 441/80, 88, 102, 103, 106, 108, 109, 111, 441/112, 114, 115, 116, 117, 41, 118, 441/119, 121, 122, 123
See application file for complete search history.

(56) References Cited

U.S. PATENT DOCUMENTS

| | | | | |
|---|---|---|---|---|
| 2,869,152 | A * | 1/1959 | Anderson | A41D 13/0125 441/109 |
| 7,721,352 | B1 * | 5/2010 | Swift | A41D 13/0125 2/82 |
| 8,978,164 | B2 | 3/2015 | Jones | |
| 10,154,696 | B1 * | 12/2018 | Price | A41D 13/0125 |
| 10,485,276 | B2 * | 11/2019 | Price | A41D 13/0125 |
| 10,897,937 | B2 * | 1/2021 | Price | A41D 1/065 |
| 12,564,240 | B1 * | 3/2026 | Brown | A41D 13/012 |
| 2008/0076309 | A1 | 3/2008 | Sandrin | |
| 2019/0069613 | A1 | 3/2019 | Price | |
| 2022/0287394 | A1 * | 9/2022 | Elliff | A41D 13/0051 |
| 2025/0268317 | A1 * | 8/2025 | Chaney | A41D 13/02 |

* cited by examiner

*Primary Examiner* — Daniel V Venne
(74) *Attorney, Agent, or Firm* — Brennan, Manna & Diamond, LLC

(57) ABSTRACT

A combined pair of hip waders and life vest device is disclosed. The device includes a buoyant upper body cover portion to cover the upper body of a user and includes a right frontal member and a left frontal member. The right frontal member, the left frontal member, and a back member include floatation devices which include detachable buoyant materials for providing buoyancy to a wearer in water. A right shoulder strap and a left shoulder strap extend from the top edges of the right frontal member and the left frontal member, respectively, to the top edge of the back member. A lower body cover portion functions as hip waders and extends below the upper body cover section. The lower body cover section or portion includes a left leg hip wader and a right leg hip wader.

20 Claims, 6 Drawing Sheets

MULTIFUNCTIONAL HIP WADERS

CROSS-REFERENCE TO RELATED APPLICATION

The present application claims priority to, and the benefit of, U.S. Provisional Application No. 63/553,160, which was filed on Feb. 14, 2024, and is incorporated herein by reference in its entirety.

FIELD OF THE INVENTION

The present invention generally relates to the field of hip waders. More specifically, the present invention relates to a novel pair of hip waders that also act as a life vest. An upper section of the waders includes buoyant material for providing buoyancy. The device does not have any gaps and is made up of neoprene and polyester. The hip waders device can be worn using a pair of adjustable shoulder straps. The device keeps the wearer afloat and improves safety while fishing, duck hunting, and much more. Accordingly, the present disclosure makes specific reference thereto. Nonetheless, it is to be appreciated that aspects of the present invention are also equally applicable to other like applications, devices, and methods of manufacture.

BACKGROUND

By way of background, hunters, fishermen, and outdoor enthusiasts often spend significant time in close proximity to bodies of water such as lakes, ponds, and rivers as they pursue their recreational activities such as fishing and hunting. Individuals commonly use hip waders to keep their feet and pants dry. However, such water bodies pose inherent risks, including the potential for accidental immersion and drowning. Standard hip waders lack any built-in buoyancy to aid in floatation. Moreover, traditional waders may feature open spaces through which water can enter, hindering the wearer's ability to escape, swim, and float effectively. When a user goes into deep water, keeping afloat wearing a standard hip wader is difficult and challenging.

Existing hip waders often cover the legs of a user and are not designed with the objective of keeping the wearer afloat in water emergencies. The upper body of a user is not covered by standard waders. Also, conventional hip waders lack storage spaces to carry phones and other small personal items to protect them from getting wet or drowned in water bodies. Individuals desire an improved hip waders device that addresses the shortcomings of traditional hip waders.

Therefore, there exists a long-felt need in the art for multifunctional hip waders that enables a user to remain afloat even in deep water. There is also a long-felt need in the art for a multifunctional hip waders device that integrates buoyancy features into the wader design. Additionally, there is a long-felt need in the art for a hip waders device that can be adjusted to fit body types of different users. Moreover, there is a long-felt need in the art for improved hip waders that enables a wearer to remain buoyant in the water, thereby reducing the risk of drowning in emergency situations. Further, there is a long-felt need in the art of improved hip waders that does not have any gaps for water to pour into the hip waders. Furthermore, there is a long-felt need in the art for an improved hip wader design that includes detachable buoyant material allowing a wearer to remain buoyant in the water. Finally, there is a long-felt need in the art for a novel hip wader design that combines the functionality of traditional hip waders with buoyancy, thereby reducing the risk of drowning and enhancing overall safety during water-based activities.

The subject matter disclosed and claimed herein, in one embodiment thereof, comprises a multifunctional hip waders device. The device can be worn by a user while being near a body of water and includes an upper body cover section designed to cover the upper body of a wearer, a lower body cover section or portion or hip waders section designed to cover the legs of the wearer, and at least one floatation device integrated into the upper body cover section for preventing drowning of the wearer. The device also includes adjustable right and left shoulder straps for securing the device to the wearer. The hip waders section includes right and left leg hip waders, rubber insulated boots, slidable knee pads, and a belt for providing additional security and comfort to the wearer. The floatation devices provide necessary buoyant forces to keep the wearer of the device afloat in a body of water.

In this manner, the hip waders system of the present invention accomplishes all of the foregoing objectives and provides users with novel multifunctional hip waders that also function as a life vest. The waders include a buoyant material to keep the wearer afloat in a body of water. Adjustable shoulder straps with buckles enables users to customize the fit of the waders, while detachable buoyant material offers added convenience for maintenance and cleaning. The pockets allow storage of personal items and a wading belt can be used for providing additional comfort and safety.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a multifunctional hip waders and life vest device. The device further comprises an upper body cover section designed to cover the upper body of a wearer, a lower body cover section or portion or hip waders section designed to cover the legs of the wearer, and at least one floatation device integrated into the upper body cover section for preventing drowning of the wearer. The device also includes adjustable right and left shoulder straps for securing the device to the wearer. The hip waders section includes right and left leg hip waders, rubber insulated boots, slidable knee pads, and a belt for providing additional security and comfort to the wearer.

In yet another embodiment, a multifunctional hip waders and life vest device is disclosed. The device comprises an upper body cover section which includes a right frontal member and a left frontal member integrated to the opposing edges of a back member of the upper body cover section, wherein the right frontal member and the left frontal member are detachably fastened to cover the frontal body of a wearer using zippers disposed on their free edges. A right shoulder strap and a left shoulder strap extend from the top edges of the right frontal member and the left frontal member respectively to the top edge of the back member, wherein each shoulder strap includes a buckle for adjusting the length thereof. The back member includes a pair of floatation devices disposed therein, the floatation devices include detachable buoyant materials for providing buoyancy to a wearer in water. A lower body cover section or portion extends below the upper body cover section and includes a left leg hip wader and a right leg hip wader, each hip wader has a rubber insulated boot and a knee pad.

In another aspect, the device is constructed using neoprene material with polyester, wherein the material includes 60% to 90% neoprene and 10% to 40% polyester.

In yet another aspect, the floatation devices integrated into the upper body cover section are removable and replaceable.

In yet another embodiment, the device includes one or more sealed pockets disposed on the upper body cover section and/or the lower body cover section or portion for storing personal items.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
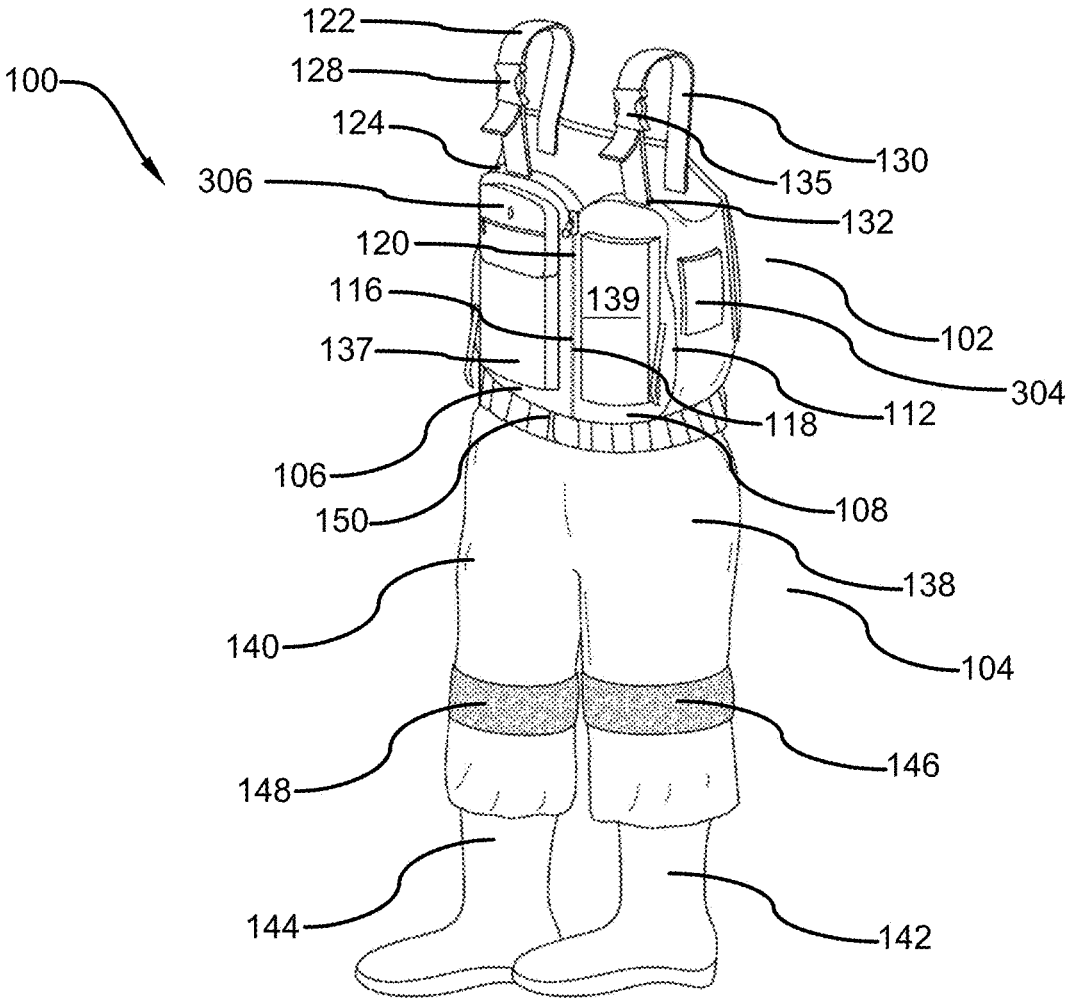
FIG. 1 illustrates a front perspective view of the integrated hip waders and life vest device of the present invention in accordance with one embodiment of the disclosed structure.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for multifunctional hip waders that enables a user to remain afloat even in deep water. There is also a long-felt need in the art for a multifunctional hip waders device that integrates buoyancy features into the wader design. Additionally, there is a long-felt need in the art for a hip waders device that can be adjusted to fit to body of different users. Moreover, there is a long-felt need in the art for improved hip waders that enables a wearer to remain buoyant in the water, reducing the risk of drowning in emergency situations. Further, there is a long-felt need in the art of improved hip waders that does not have any gaps for water to pour into the hip waders. Furthermore, there is a long-felt need in the art for an improved hip wader design that includes detachable buoyant material allowing a wearer to remain buoyant in the water. Finally, there is a long-felt need in the art for a novel hip wader design that combines the functionality of traditional hip waders with buoyancy, thereby reducing the risk of drowning and enhancing overall safety during water-based activities.

The present invention, in one exemplary embodiment, is a multifunctional hip waders and life vest device. The device features an upper body cover section to cover the upper body of a user and includes a right frontal member and a left frontal member. The right frontal member and the left frontal member are detachably fastened to cover the frontal body of a wearer using zippers disposed on their free edges. A right shoulder strap and a left shoulder strap extend from the top edges of the right frontal member and the left frontal member respectively to the top edge of the back member, wherein each shoulder strap includes a buckle for adjusting the length thereof. A back member includes a pair of floatation devices disposed therein, the floatation devices include detachable buoyant materials for providing buoyancy to a wearer in water. A lower body cover section or portion extends below the upper body cover section and includes a left leg hip wader and a right leg hip wader, each hip wader has a rubber insulated boot and a knee pad.

Figure 2:
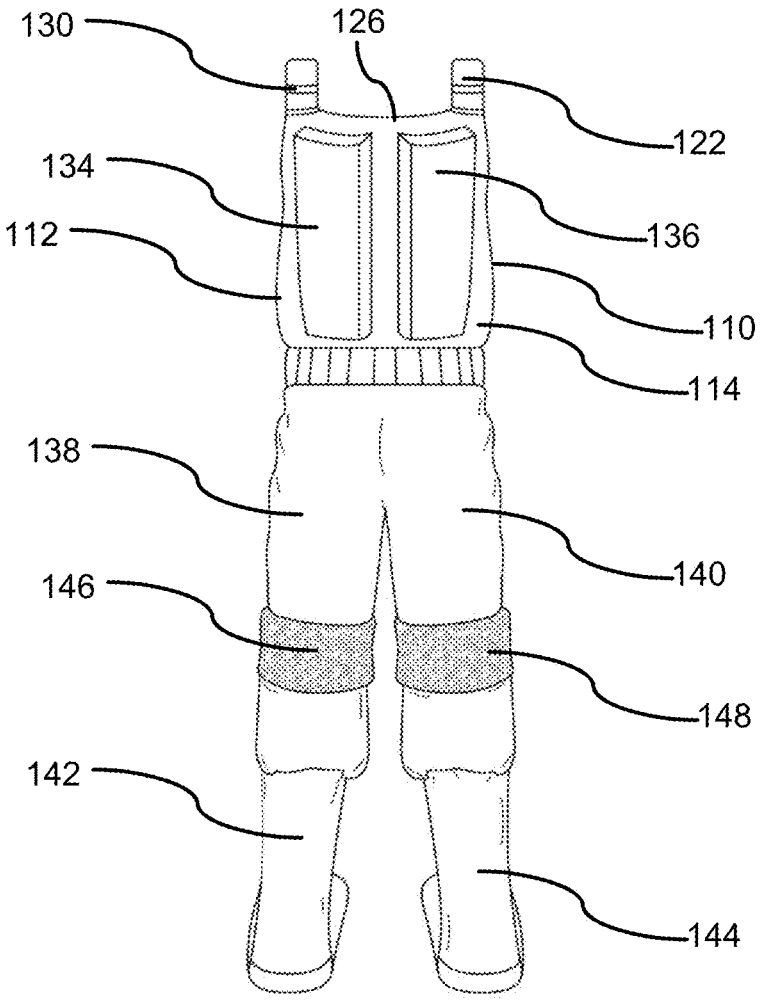
FIG. 2 illustrates a rear perspective view of the integrated hip waders and life vest device of the present invention in accordance with one embodiment of the disclosed structure.
Figure 3:
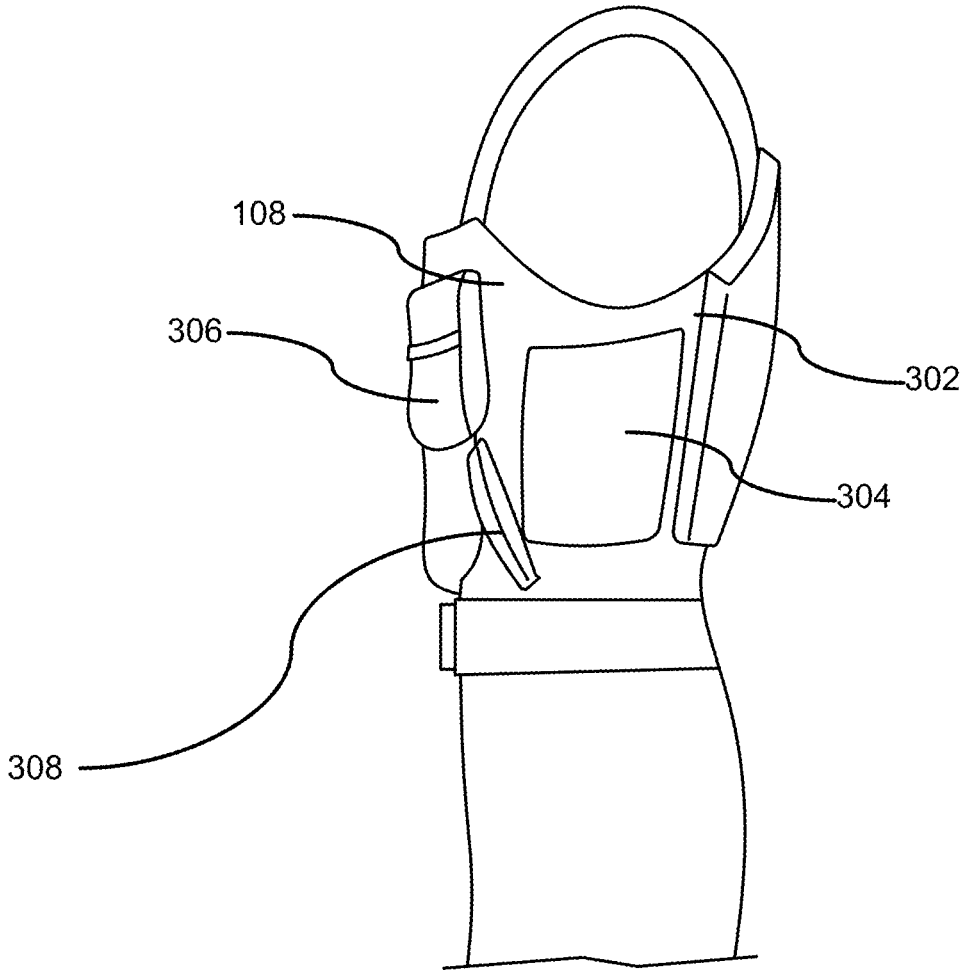
FIG. 3 illustrates a side perspective view of the integrated hip waders and life vest device of the present invention in accordance with one embodiment of the disclosed structure.

Referring initially to the drawings, FIGS. 1-3 illustrate different perspective views of the integrated hip waders and life vest device of the present invention in accordance with one embodiment of the disclosed structure. Referring now to FIGS. 1 and 2, the integrated hip waders and life vest device 100 of the present invention is designed as a multifunctional hip waders device that provides continuous flotation support to a wearer of the hip waders device 100. The device 100 enables a wearer of the device 100 to remain buoyant in the water, reducing the risk of drowning in emergency situations such as in deep water. More specifically, the multifunctional hip waders 100 preferably has a one-piece construction and includes an upper body cover section or portion 102 designed to cover the upper body of a wearer and a lower body cover section or portion or hip waders section 104 designed to cover the legs of the wearer.

The upper body cover section or portion 102 includes a right frontal member 106 and a left frontal member 108. The right frontal member 106 and the left frontal member 108 are integrated to the right edge 110 and left edge 112 respectively of the back member 114 of the upper body cover section or portion 102. The free edge 116 of the right frontal member 106 and the free edge 118 of the left frontal member 108 have zipper 120 for detachably fastening the right frontal member 106 and the left frontal member 108 to cover the frontal body of a wearer of the device 100.

A right shoulder strap 122 extends from the top edge 124 of the right frontal member 106 to the top edge 126 of the back member 114. Preferably, the right shoulder strap 122 is sewn to the top edges 124, 126 and includes a buckle 128 for adjusting length of the right shoulder strap 122 to fit the device 100 to different users. A left shoulder strap 130 extends from the top edge 132 of the left frontal member 108 to the top edge 126 of the back member 114. The left shoulder strap 130 is sewn to the top edges 132, 126 and includes a buckle 135 for adjusting length of the left shoulder strap 130 to fit the device 100 to different users.

The back member 114 includes a pair of floatation devices 134, 136 which are in the form of detachable buoyant material for helping a user float in a body of water, reducing the risk of drowning in emergency situations. The floating devices 134, 136 are removable from the back member 114 and can be replaced with new floatation devices. Similar floatation devices 137, 139 can also be disposed in the right frontal member 106 and the left frontal member 108, respectively.

The hip waders section 104 extends below from the upper body cover section or portion 102 and is designed to include left leg hip wader 138 and a right leg hip wader 140. A left leg insulated boot (i.e., rubber) 142 and a right leg insulated boot (i.e., rubber) 144 are included in the device 100 for providing adequate protection and grip to a wearer in a body of water and nearby areas. The boots 142, 144 maintain comfort and protect the wearer against water ingress, especially in wet or cold conditions. A pair of slidable knee pads 146, 148 are disposed on the waders 138, 140 respectively. The knee pads 146, 148 provide protection to knees of the wearer of the device 100 when the wearer kneels on a surface. A belt 150 can be integrated or detachably placed for providing additional security and comfort to the wearer.

The multifunctional safe waders 100 can be constructed using neoprene material with polyester, wherein the material can include 60% to 90% neoprene and 10% to 40% polyester. It will be apparent to a person skilled in the art that the placement of the buoyant material above the waistline enables for the comfortable wear of a wading belt, which is commonly used in activities like fishing to provide additional support and safety.

FIG. 3 illustrates a side perspective view of the combined hip waders and life vest device 100 in accordance with the disclosed structure. The side surface 302 of the left frontal member 108 (and of the right frontal member 106) includes a floatation device 304 for providing additional floatation support to a wearer of the device 100. As illustrated in FIGS. 1 and 3, one or more pockets 306 are disposed on the frontal members 106, 108 for storing personal items such as phones and more. The pockets 306 are sealed and prevent water from entering therein. At least one side pocket 308 is also included in the device 100 which functions like a hand warmer for providing body heat and warmth to the hand of the wearer of the device 100.

Figure 4:
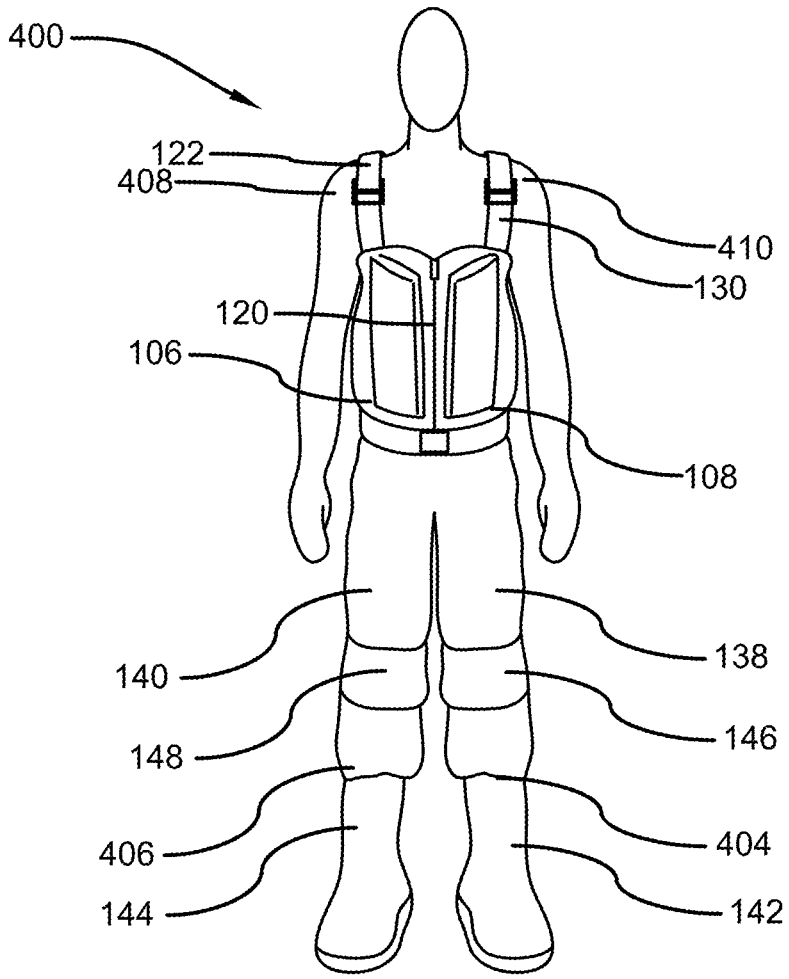
FIG. 4 illustrates a front perspective view of a user wearing the multifunctional combined hip waders and life vest device of the present invention in accordance with the disclosed structure.

FIG. 4 illustrates a front perspective view of a user wearing the multifunctional combined hip waders and life vest device of the present invention in accordance with the disclosed structure. As illustrated, the right frontal member 106 and the left frontal member 108 covers the upper body 402 of the user 400. The left leg hip wader 138 and the right leg hip wader 140 covers the legs of the wearer 400 and the belt 150 is easily worn by the user 400 for additional security and comfort. The upper body cover section or portion 102 adheres to the body of the user 400 and therefore, does not provide space for the water to pour into the device 100.

The bottom ends 404, 406 of the left leg hip wader 138 and the right leg hip wader 140 respectively are preferably tucked inside the boots 142, 144 for preventing water flowing into the boots 142, 144. The device 100 can be designed in different sizes to meet requirements of different users. The shoulder straps 122, 130 go around the shoulders 408, 410 of the user 400 for securing the device 100 easily wherein the device 100 is used both as hip waders and life vest.

Figure 5:
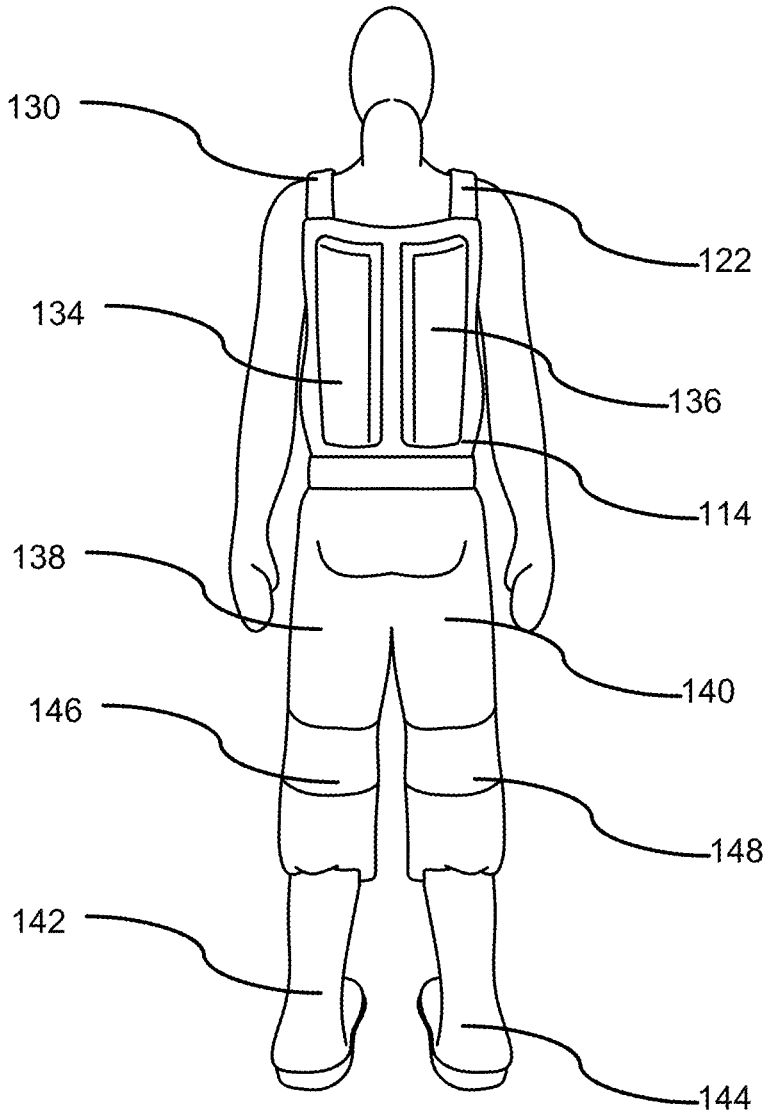
FIG. 5 illustrates a rear perspective view of the wearer wearing the multifunctional hip waders in accordance with the disclosed structure.

FIG. 5 illustrates a rear perspective view of the wearer wearing the multifunctional hip waders in accordance with the disclosed structure. The floatation devices 134, 136 provide support to at least 90% of a length of the back area of the user 400, thereby preventing drowning of the user. The top edge 126 of the back member 114 extends up to the shoulder blades of the user 400.

Figure 6:
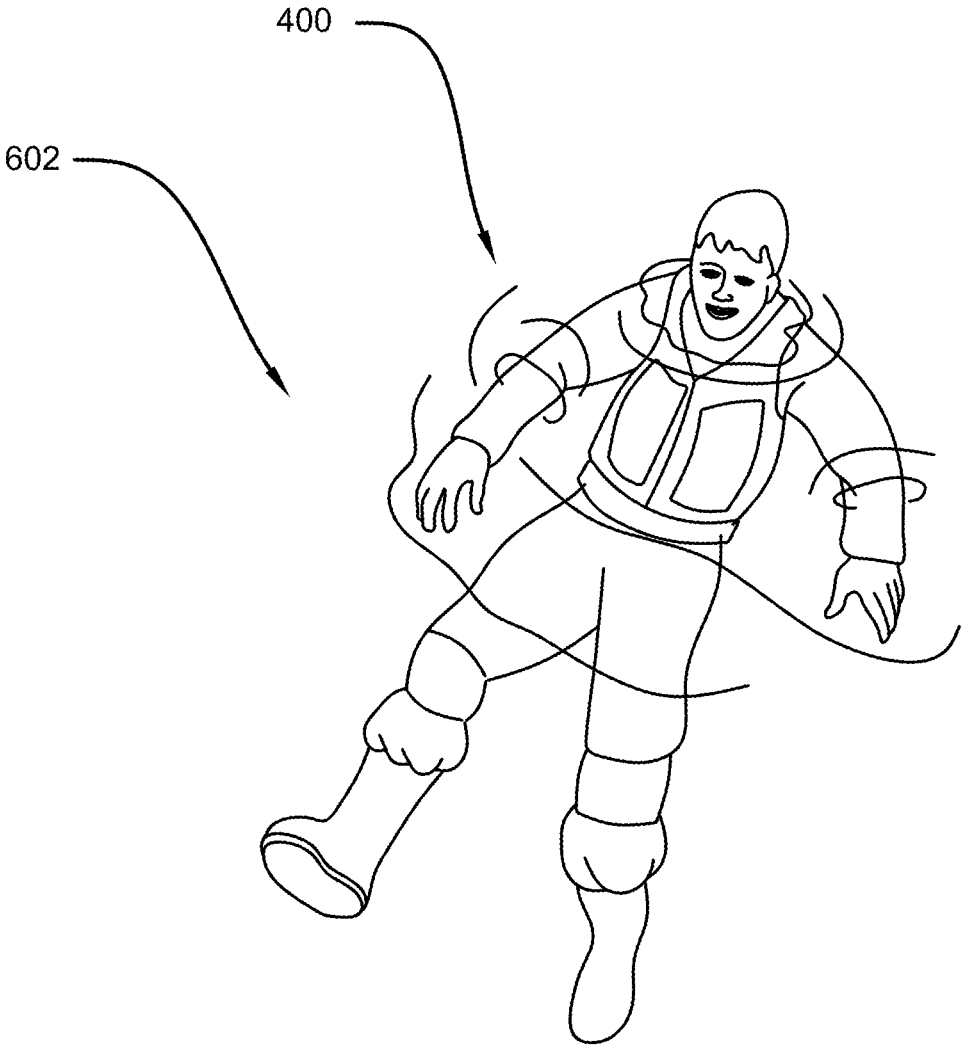
FIG. 6 illustrates a perspective view of a user floating in a body of water while wearing the multifunctional hip waders in accordance with the disclosed structure.

FIG. 6 illustrates a perspective view of a user floating in a body of water while wearing the multifunctional hip waders in accordance with the disclosed structure. The wearer 400 floats in the water body 602 using the floatation devices which provide the necessary buoyant force for allowing the user to float easily. The device 100 functions as a conventional life vest for preventing user to drown in the water body 602.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "integrated hip waders and life vest device", "multifunctional hip waders", "combined hip waders and life vest device", and "device" are interchangeable and refer to the multifunctional combined hip waders and life vest device 100 of the present invention.

Notwithstanding the foregoing, the multifunctional combined hip waders and life vest device 100 of the present invention can be of any suitable size and configuration as is known in the art without affecting the overall concept of the invention, provided that it accomplishes the above-stated objectives. One of ordinary skill in the art will appreciate that the multifunctional combined hip waders and life vest device 100 as shown in the FIGS. are for illustrative purposes only, and that many other sizes and shapes of the multifunctional combined hip waders and life vest device 100 are well within the scope of the present disclosure. Although the dimensions of the multifunctional combined hip waders and life vest device 100 are important design parameters for user convenience, the multifunctional combined hip waders and life vest device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An integrated hip waders and life vest device comprising:

an upper body cover portion;

a lower body cover portion;

a right frontal member;

a left frontal member;

a right shoulder strap;

a left shoulder strap;

a back member; and a plurality of floatation devices;

wherein said upper body cover portion including said right frontal member, said left frontal member, and said back member;

wherein said right frontal member integrated to a right edge of said back member of said upper body cover portion;

wherein said left frontal member integrated to a left edge of said back member of said upper body cover portion;

wherein said right frontal member having a right free edge and said left frontal member having a left free edge;

wherein said right free edge and said left free edge having a fastener therebetween for selective attachment of said right frontal member to said left frontal member;

wherein said back member having at least a pair of said plurality of floatation devices attached thereto; and further wherein said right frontal member having at least one of said plurality of floatation devices attached thereto and said left frontal member having at least one of said plurality of floatation devices attached thereto.

2. The integrated hip waders and life vest device of claim 1, wherein said right shoulder strap extending from a right top edge of said right frontal member to a top edge of said back member.

3. The integrated hip waders and life vest device of claim 2, wherein said left shoulder strap extending from a left top edge of said left frontal member to said top edge of said back member.

4. The integrated hip waders and life vest device of claim 3, wherein said lower body cover portion having a left leg hip wader and a right leg hip wader.

5. The integrated hip waders and life vest device of claim 4, wherein said left leg hip wader having a left leg insulated boot and said right leg hip wader having a right leg insulated boot.

6. The integrated hip waders and life vest device of claim 5, wherein said fastener is a zipper.

7. The integrated hip waders and life vest device of claim 6, wherein each of said plurality of floatation devices having selectively detachable buoyant material.

8. An integrated hip waders and life vest device comprising:

an upper body cover portion;

a lower body cover portion;

a right frontal member;

a left frontal member;

a right shoulder strap;

a left shoulder strap;

a back member; and a plurality of floatation devices;

wherein said upper body cover portion including said right frontal member, said left frontal member, and said back member;

wherein said right frontal member integrated to a right edge of said back member of said upper body cover portion;

wherein said left frontal member integrated to a left edge of said back member of said upper body cover portion;

wherein said right frontal member having a right free edge and said left frontal member having a left free edge;

wherein said right free edge and said left free edge having a fastener therebetween for selective attachment of said right frontal member to said left frontal member;

wherein said back member having at least a pair of said plurality of floatation devices attached thereto;

wherein said right frontal member having at least one of said plurality of floatation devices attached thereto and said left frontal member having at least one of said plurality of floatation devices attached thereto;

wherein said upper body cover portion positioned above a waistline of a wearer; and further wherein said upper body cover portion and said lower body cover portion having a material comprising from 60% to 90% neoprene and from 10% to 40% polyester.

9. The integrated hip waders and life vest device of claim 8, wherein said right shoulder strap extending from a right top edge of said right frontal member to a top edge of said back member.

10. The integrated hip waders and life vest device of claim 9, wherein said left shoulder strap extending from a left top edge of said left frontal member to said top edge of said back member.

11. The integrated hip waders and life vest device of claim 10, wherein said lower body cover portion having a left leg hip wader and a right leg hip wader.

12. The integrated hip waders and life vest device of claim 11, wherein said left leg hip wader having a left leg insulated boot and said right leg hip wader having a right leg insulated boot.

13. The integrated hip waders and life vest device of claim 12, wherein said fastener is a zipper.

14. The integrated hip waders and life vest device of claim 13, wherein each of said plurality of floatation devices having selectively detachable buoyant material.

15. An integrated hip waders and life vest device comprising:

an upper body cover portion;

a lower body cover portion;

a right frontal member;

a left frontal member;

a right shoulder strap;

a left shoulder strap;

a back member; and a plurality of floatation devices;

wherein said upper body cover portion including said right frontal member, said left frontal member, and said back member;

wherein said right frontal member integrated to a right edge of said back member of said upper body cover portion;

wherein said left frontal member integrated to a left edge of said back member of said upper body cover portion;

wherein said right frontal member having a right free edge and said left frontal member having a left free edge;

wherein said right free edge and said left free edge having a fastener therebetween for selective attachment of said right frontal member to said left frontal member;

wherein said back member having at least a pair of said plurality of floatation devices attached thereto;

wherein said at least a pair of said plurality of floatation devices extending along at least 90% of a length of said back member;

wherein said right frontal member having at least one of said plurality of floatation devices attached thereto and said left frontal member having at least one of said plurality of floatation devices attached thereto; and further wherein said upper body cover portion positioned above a waistline of a wearer.

16. The integrated hip waders and life vest device of claim 15, wherein said upper body cover portion and said lower body cover portion having a material comprising from 60% to 90% neoprene and from 10% to 40% polyester.

17. The integrated hip waders and life vest device of claim 15, wherein said right shoulder strap extending from a right top edge of said right frontal member to a top edge of said back member.

18. The integrated hip waders and life vest device of claim 17, wherein said left shoulder strap extending from a left top edge of said left frontal member to said top edge of said back member.

19. The integrated hip waders and life vest device of claim 15, wherein said lower body cover portion having a left leg hip wader and a right leg hip wader.

20. The integrated hip waders and life vest device of claim 15, wherein each of said plurality of floatation devices having selectively detachable buoyant material.

* * * * *